United States Patent [19]

Meeks

[11] 4,253,648

[45] Mar. 3, 1981

[54] ADJUSTABLE OFF-SET SPRING LOADED CLAMP AND STAND

[76] Inventor: Charles H. Meeks, 25907 Belle Porte Ave., Harbor City, Calif. 90710

[21] Appl. No.: 96,930

[22] Filed: Nov. 23, 1979

[51] Int. Cl.[3] ..... B25B 1/24

[52] U.S. Cl. ..... 269/4; 269/6; 269/71; 269/82; 269/203; 269/282

[58] Field of Search ..... 269/3, 4, 6, 47, 203, 269/210, 214, 71, 82, 282; D8/14.1; 254/106

[56] References Cited

U.S. PATENT DOCUMENTS

| | | | |
|---|---|---|---|
| D. 246,221 | 11/1977 | Cox | D8/14.1 |
| 2,327,368 | 8/1943 | Olson | 269/282 X |
| 2,544,329 | 3/1951 | Kirk | 269/4 X |
| 3,323,787 | 6/1967 | Schetzer | 269/4 |
| 3,427,016 | 2/1969 | Harris | 269/214 |
| 3,492,854 | 2/1970 | Eppler | 254/106 X |

*Primary Examiner*—Robert C. Watson

*Attorney, Agent, or Firm*—Keith D. Beecher

[57] ABSTRACT

An adjustable off-set spring loaded clamp is provided for assisting in welding, and other operations, and a stand is also provided which supports the clamp in any desired position and orientation. The clamp and stand both include coarse and fine adjustments whereby the jaws of the clamp can be set precisely to any desired initial separation, and whereby the clamp may be adjusted precisely to any desired orientation and held in the desired orientation, so as to enable the clamp to accomplish a wide range of holding functions.

15 Claims, 11 Drawing Figures

10
100
100A
102
104
106
108
110
112
113
114
115
116
118
120
122
124
126
130
132
134
150
50
5A
5B
5C
5D

ADJUSTABLE OFF-SET SPRING LOADED CLAMP AND STAND

SUMMARY OF THE INVENTION

The clamp to be described is equipped with an outer jaw which, in turn, is supported on a first shaft, the first shaft being telescopically received in a hollow second shaft so that the outer jaw may be set to any desired displacement with respect to an inner jaw. This enables the clamp to fit a wide variety of workpieces of different thicknesses and/or widths. Spare outer jaws and associated shafts may be provided of different lengths further to enlarge the adaptability of the clamp assembly. The hollow second shaft is attached to a fixed handle. The inner jaw is attached to a hollow third shaft which slides on the second shaft, and which is coupled to a second handle. The second handle is pivoted to the first handle, and is spring loaded. The third shaft is coupled to the spring loaded second handle by means of a bolt which may be turned to provide a fine adjustment to the spacing between the jaws of the clamp. A second bolt is stored on the fixed handle, and it may be removed and screwed into one of the jaws to permit the clamp to be used with workpieces having side walls around the surface to be clamped. The clamp of the invention is removably supported on a stand which acts as a universal joint, and which permits the clamp to be turned to and held at any desired orientation on the stand. Coarse and fine adjustments are provided to adjust the height and horizontal displacement of the clamp on the stand, as well as its vertical and horizontal angular displacements.

DETAILED DESCRIPTION OF THE ILLUSTRATED EMBODIMENTS

Figures 1, 1A, 2, 3:
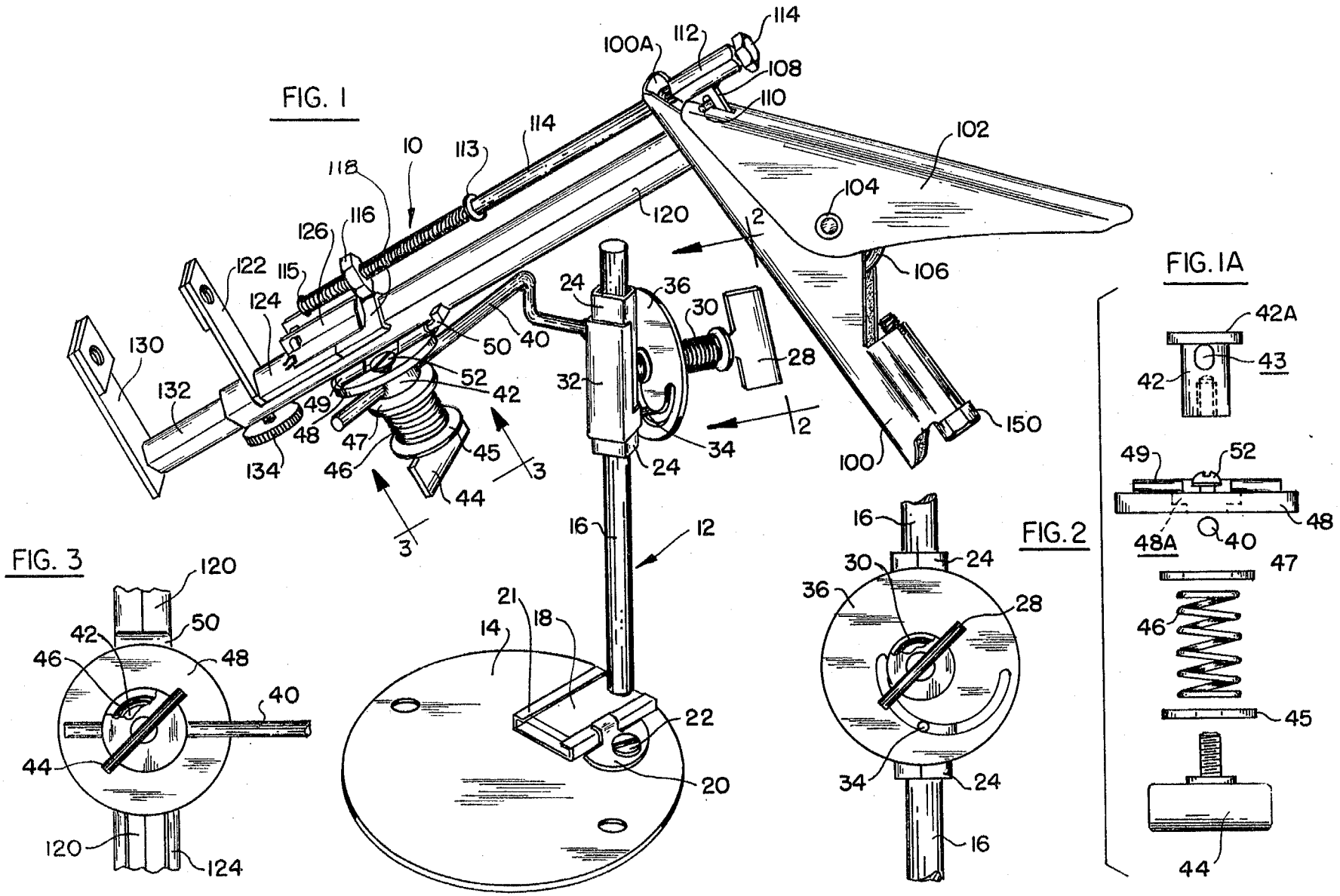
FIG. 1 is a perspective representation showing the adjustable off-set spring loaded clamp assembly of the invention in one of its embodiments supported on a stand which also embodies the concepts of the invention.
FIG. 1A is an exploded view of certain of the components of the assembly of FIG. 1.
FIG. 2 is a detailed view of the representation of FIG. 1 taken along the lines 2—2 of FIG. 1.
FIG. 3 is a detailed view of the representation of FIG. 1 taken along the lines 3—3 of FIG. 1.

As shown in FIG. 1, the embodiment of the invention illustrated therein includes an off-set, spring loaded clamp 10 and a supporting bracket 12. The supporting bracket includes a base 14 which may be attached to an appropriate supporting surface, such as a bench, a table or a desk; and it also includes an upright post 16 which is supported on the base by means of a pedestal 18 and a bracket 21, the bracket being mounted on base 14.

Pedestal 18 is held in bracket 21 by means of a clamp 20 and screw 22.

A sleeve 24 is slidable on post 16, and the sleeve may be raised to any desired height on the post and turned to any desired angular position thereon. The sleeve is set at the selected height and angular position by means of a wing screw 28, the screw being spring loaded by a spring 30. Sleeve 24, as illustrated, has a square cross-section. A second sleeve 32 which, likewise, has a square cross-section, is slidable on sleeve 24. Sleeve 32 is held in position by a pin 34 which extends through a slot in a disc 36 (see also FIG. 2). Disc 36 is rotatably mounted on screw 28. Rotation of disc 36 provides a fine height adjustment for a bar 40 attached to sleeve 32. Spring 30 also puts tension on disc 36 to prevent it from being turned by the force exerted by pin 34 due to the weight of the clamp, or from turning too easily when a fine adjustment is made.

The clamp 10 is mounted on the bar 40 by means of a post 42, the bar extending through a hole in the post. The post is set on the bar by a wing screw 44 which is spring loaded by a spring 46. As shown in FIGS. 1 and 3, the post 42 is attached to the clamp by a disc 48 which has a sleeve 49 attached thereto.

Details of the assembly are shown in the exploded view of FIG. 1A. As shown, post 42 has a flat head 42A which fits in a central depression 48A in disc 48 so that head 42A is flush with the surface of the disc. Post 42 has an elongated hole 43 which receives bar 40. Disc 48 pivots about the axis of post 42 and also around the axis of bar 40 for universal movement of the disc so long as wing screw 44 is loose. When the wing screw is tightened, bar 40 is displaced across elongated hole 43 into tight engagement with the surface of disc 48 to clamp the disc. The force of spring 46 between its two washers 45 and 47 makes it possible to loosen the wing screw 44 slightly for universal movement of the assembly without the clamp falling of its own weight. A slide 50 attached to the clamp is received in the sleeve, and the disc 48 is set to the slide by a set screw 52. Slide 50 may be disconnected from disc 48 and the clamp may be directly supported on base 14 in a horizontal position, if so desired. This is achieved by removing pedestal 18 and clamping slide 50 in bracket 21.

It will be appreciated that the clamp may be held in any desired orientation by the bracket, and at any desired height with respect to the supporting surface. Also, as described, a fine adjustment for the height of the clamp is provided by rotating disc 36.

The details of the off-set spring loaded clamp 10 are shown in FIGS. 1, 4, 5, 5A–5D. As described briefly above, the various parts which make up the clamp may be adjusted and changed quickly and easily to permit the clamp to achieve a wide variety of holding functions.

The clamp includes a stationary handle 100 and a movable handle 102. The two handles are pivotally coupled to one another by a rivet 104 which extends along a pivot axis. Rivet 104 is flat headed and is mounted flush with the sides of the handles to permit the clamp to be laid flat on its side when removed from the bracket assembly of FIG. 1. The handle 102 is spring biased about the pivot axis by a spring 106.

The upper end of handle 102 is coupled to a clevis 108 by means of a pin 110. Clevis 108 is attached to a sleeve 112. A bolt 114 is rotatably mounted in sleeve 112, and the bolt extends through a hole in an extension 100A of stationary handle 100. The bolt is threaded through a nut 116 which, in turn, is affixed to a hollow shaft 118 of square cross-section. Shaft 118 is slidable on an elongated hollow shaft 120, the latter shaft also having a square cross-section. One end of shaft 120 is affixed to extension 100A of the stationary handle 100. Slide 50 is attached to shaft 120.

The inner jaw 122 of the clamp is the movble jaw. The movable jaw is attached to a hollow shaft 124 which has a square cross-section. Shaft 124 is coupled to shaft 118 through a releasable spring-loaded coupling 126, so that shafts 118 and 124 may be coaxially slidably supported on shaft 120. Coupling 126 permits the inner jaw 122 and its shaft 124 to be removed and replaced, if desired, with another inner jaw having a shaft, like shaft 124, but with the latter inner jaw having a different shape or height.

Figure 4:
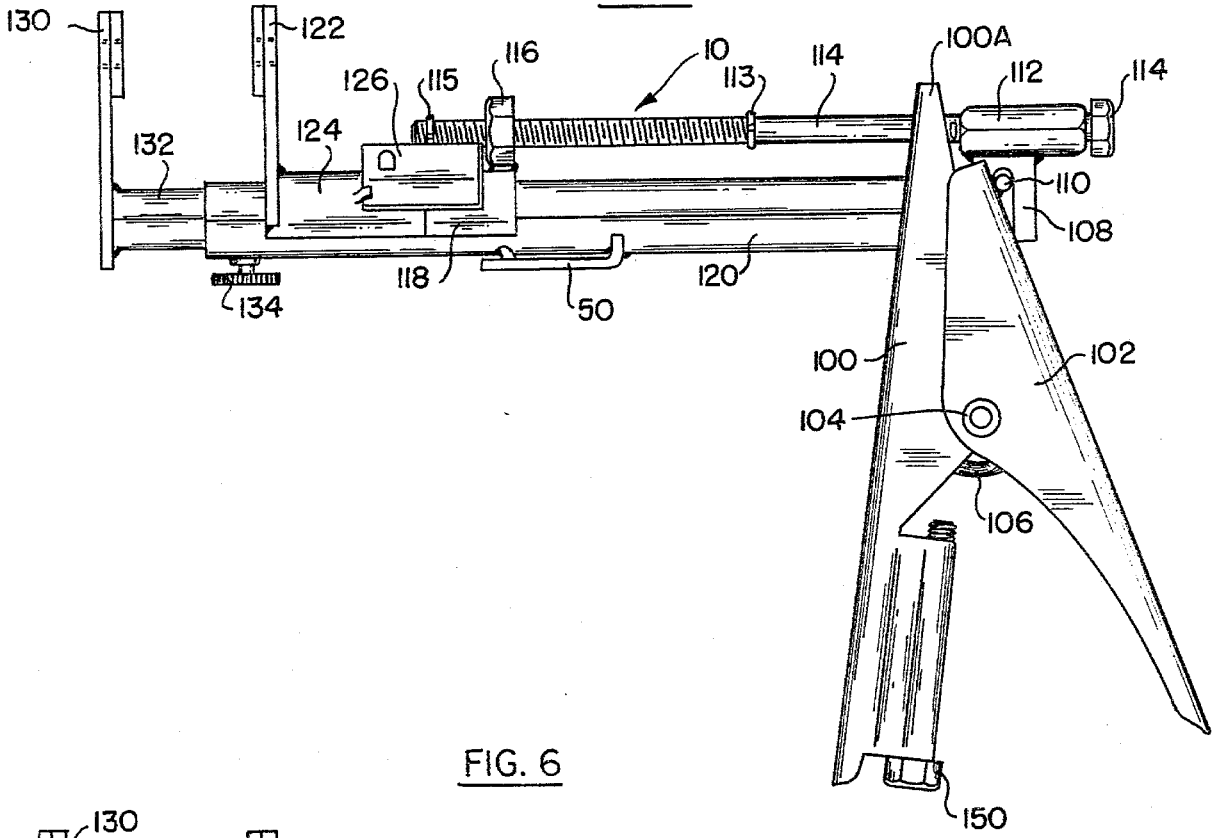
FIG. 4 is a side elevation of the clamp shown in FIG. 1.

It will be appreciated that when the spring loaded handles of the clamp are squeezed together, jaw 122 is moved to the right in FIG. 4 against the force of spring 106. Also, the bolt 114 may be turned to provide a fine adjustment for the inner jaw. Washers 113 and 115 serve as stops to limit the fore and aft fine adjustment of the inner jaw. Washer 13 also serves to limit the distance bolt 114 may travel to the right in FIG. 1 as the handles are squeezed. The limiting action occurs when washer 113 engages portion 100A of handle 100.

The outer jaw 130 of the clamp is attached to the end of a shaft 132. Shaft 132 also has a square cross-section, and it is received in telescopic sliding relationship in shaft 120. The outer jaw of the clamp may be set to any desired displacement with respect to the inner jaw by loosening the set screw 134, moving the outer jaw to a desired displacement with respect to the inner jaw, and then by tightening the set screw 134. Also, as mentioned above, shaft 132 and outer jaw 130 may be removed from the clamp and replaced by another outer jaw of a different height and/or shape, and/or shaft of a different length than shaft 132, if so desired. Also, jaw 130 may be clamped in bracket 21 in place of pedestal 18, if so desired, so that the clamp may be directly mounted on base 14 in a vertical position.

Figures 5, 5A, 5B, 5C, 5D:
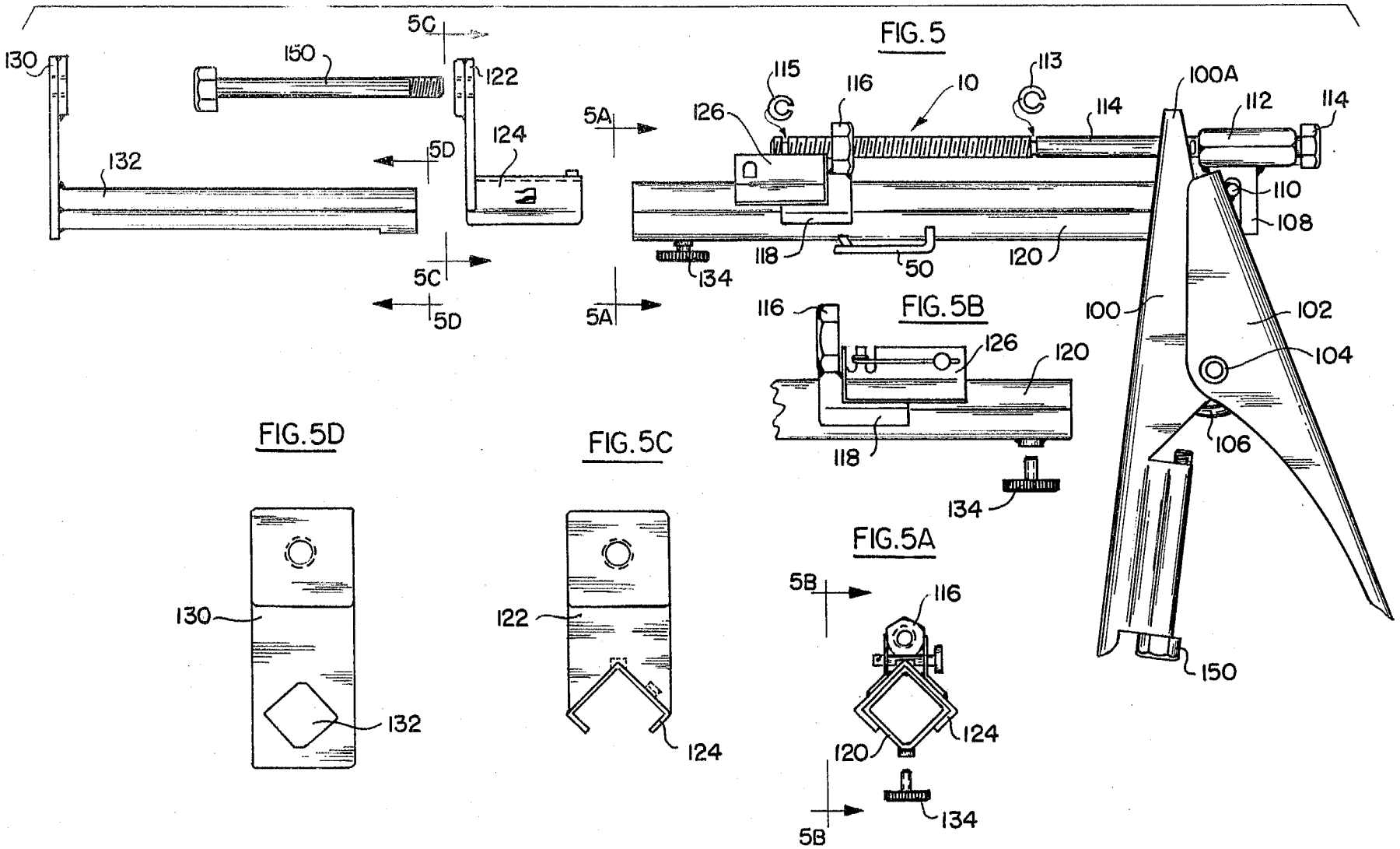
FIG. 5 is an exploded representation of the clamp of FIG. 4.
FIGS. 5A, 5C and 5D are detailed views of the representation of FIG. 5 taken respectively along the lines 5A—5A, 5C—5C and 5D—5D.
FIG. 5B is a detailed representation taken along the line 5B—5B of FIG. 5A.

As shown in FIG. 5, a bolt 150 may be screwed into a threaded hole in the inner jaw 122 to permit the clamp to be used with a workpiece having a side wall around the surface to be clamped. When not in use, the bolt 150 may be supported in an appropriate bracket in handle 100, as shown in FIGS. 4 and 5.

Figure 6:
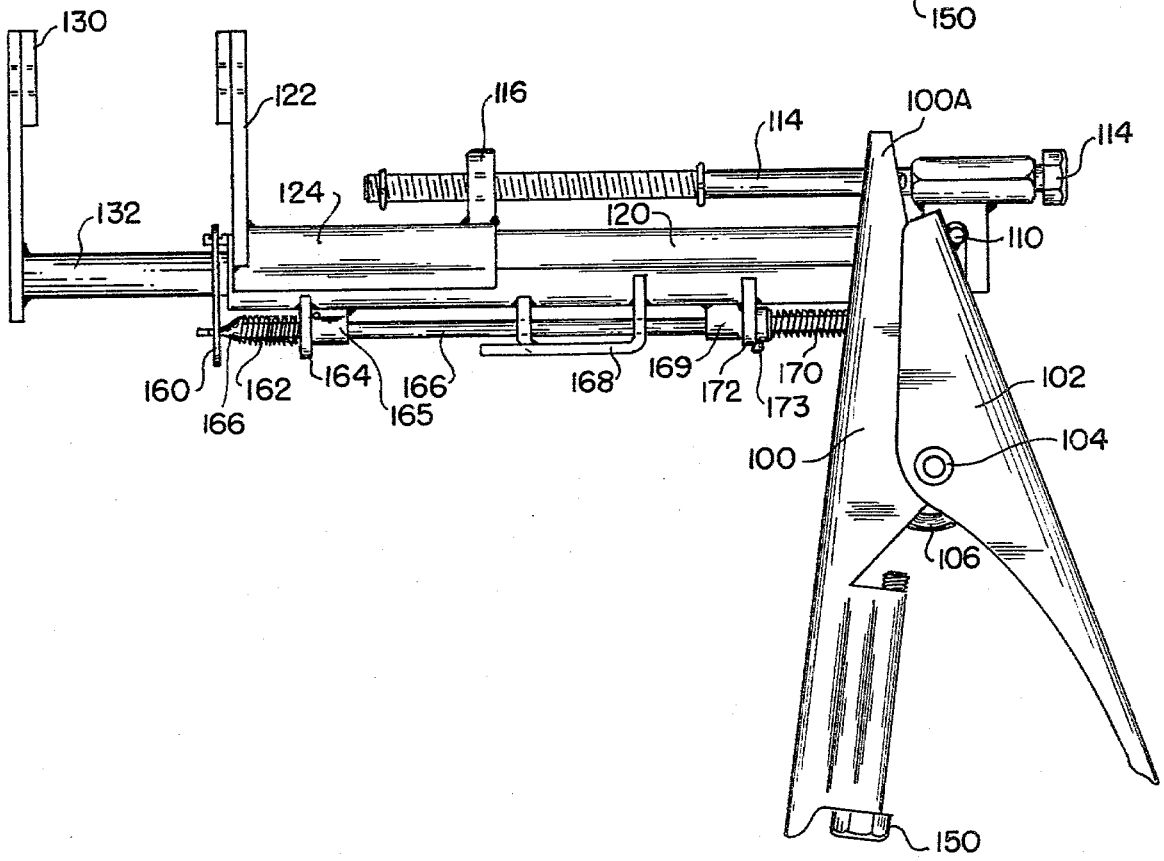
FIG. 6 is a side elevational view of a modified construction for the clamp of FIG. 4.

The clamp shown in FIG. 6 is generally similar to the clamp described above and like elements have been designated by the same numbers. However, the embodiment of FIG. 6 provides a simple adjustment for shaft 132 by replacing the set screw 134 of the previous embodiment by a washer 160 which is normally cocked by a spring 162 to an inclined position with respect to the axis of shaft 132. When the washer is in its inclined position, it engages the shaft 132 and holds the shaft against linear movement.

Spring 162 bears against a locking slide 164 which bears against a bracket 165 which is affixed to shaft 120. A second bracket 169 is also affixed to shaft 120. A rod 166, locked to washer 160, extends through bracket 165, slide 168, bracket 169 and finally through a hole in handle 100. Spring 162 bears against a shoulder of rod 166 forcing washer 160 into inclined position. Locking slide 164 moves back and forth along shaft 120 allowing a slot inside of shaft 120 to be aligned with a pin in the bottom of shaft 132 to allow its removal from shaft 120. Moved the other direction, a slot in moving slide is displaced from alignment with the pin on bottom of shaft 132 and it cannot escape from shaft 120. A finger grip 172 in locked onto rod 166 by a set screw 173. Spring 170 bears against finger grip 172 and in turn against washer 160.

When the rod 166 is moved manually to the right in FIG. 6 by finger grip 172 against the force of spring 170, it pulls washer 160 to an upright position against the force of spring 162 permitting shaft 132 to move freely in shaft 120, and enabling the shaft 132 to be moved to a new position. Then, rod 166 is released, and washer 160 again engages the shaft 132 as the washer assumes its inclined position, and locks shaft 132 in its new position.

The invention provides, therefore, an improved clamp assembly which has a wide variety of holding functions, and also an improved stand for holding the clamp assembly at any desired height and linear position, and at any desired orientation, thereby to further enhance the utility of the clamp.

It will be appreciated that although particular embodiments of the invention have been shown and described, modifications may be made. It is intended in the claims to cover all modifications which come within the true spirit and scope of the invention.

What is claimed is:

1. An adjustable off-set clamp assembly comprising: a first shaft; a first jaw attached to one end of the first shaft; a first handle attached to the other end of the first shaft; a second handle pivotally coupled to the first handle; spring means resiliently biasing the handles in opposite directions about a pivot axis; a second shaft coaxial with and slidable on said first shaft; means including an elongated member coupling the second shaft to the second handle; and a second jaw attached to the end of the second shaft to be supported thereby in spaced relationship with the first jaw.

2. The adjustable off-set clamp assembly defined in claim 1, in which the elongated member is threaded, and said coupling means includes a nut attached to said second shaft and threaded to said elongated member so that rotation of said elongated member moves the second shaft along the first shaft to constitute a fine adjustment for the second jaw.

3. The adjustable off-set clamp assembly defined in claim 1, in which said second shaft comprises two portions, and which includes means releasably coupling the two portions to one another to permit the second jaw and one of the two portions to be removed.

4. The adjustable off-set clamp assembly defined in claim 1, and which includes a third shaft coaxial with and slidable in the first shaft, said first jaw being attached to the end of the third shaft; and means for locking the first shaft to the third shaft.

5. The adjustable off-set clamp assembly defined in claim 4, in which said last-named means comprises a set screw threaded through said first shaft and engaging said third shaft.

6. The adjustable off-set clamp assembly defined in claim 4, in which said last-named means comprises a spring-loaded off-set washer coaxial with said third shaft and secured to said first shaft, spring means for biasing said washer into an inclined locked position with respect to said third shaft, and manually operable means for moving the washer into a perpendicular position with respect to said third shaft to permit movement of said third shaft.

7. The adjustable off-set clamp assembly defined in claim 1, and which includes a rivet on said pivot axis pivotally coupling the first and second handles together, the rivet having heads flush with the side surfaces of the handles to permit the clamp assembly to be laid flat on a supporting surface.

8. The adjustable off-set clamp assembly defined in claim 1, and which includes a stand for supporting the clamp at a predetermined displacement up from a supporting surface and with a predetermined orientation with respect thereto.

9. The adjustable off-set clamp assembly defined in claim 8, in which said stand includes a base, an upright post mounted on said base, a bar, first means mounting said bar on said post, and second means mounting the clamp on the bar.

10. The adjustable off-set clamp assembly defined in claim 9, in which said first means includes a first sleeve slidable on said post, and a set screw for locking the first sleeve to the post.

11. The adjustable off-set clamp assembly defined in claim 10, in which said first means further includes a second sleeve slidable on said first sleeve, with one end of said bar being attached to said second sleeve, a disc rotatable on said set screw, spring means mounted on said set screw for resiliently loading the disc, and a pin attached to said second sleeve and extending through a slot in the disc so that rotation of the disc serves as a fine adjustment for moving the second sleeve along the first sleeve.

12. The adjustable off-set clamp assembly defined in claim 9, in which said second means includes a post having a hole therein for receiving the bar, and a set screw for locking the post to the bar as a set linear position and angular position of the bar.

13. The adjustable off-set clamp assembly defined in claim 12, in which said second means further includes a sleeve attached to said post, a slide attached to said clamp and slidable in said sleeve, and a set screw for locking the slide to the post at a set linear position within the sleeve.

14. The adjustable off-set clamp assembly defined in claim 1, in which one of the jaws has a hole therein, and which includes a rod adapted to be threaded into the hole to adapt the clamp for use with workpieces having side walls extending around the surface to be clamped.

15. The adjustable off-set clamp assembly defined in claim 14, and which includes a bracket mounted on one of said handles for supporting said last-named rod when the rod is not in use.

* * * * *